US010844560B2

(12) United States Patent
Ramaekers et al.

(10) Patent No.: US 10,844,560 B2
(45) Date of Patent: Nov. 24, 2020

(54) BARRIER ELEMENT AND SUPPORT STRUCTURE FOR USE IN A BARRIER ELEMENT

(71) Applicant: Laura Metaal Holding B.V., Eygelshoven (NL)

(72) Inventors: Nicky Joseph Gerardus Ramaekers, Noorbeek (NL); Michael Sean Van der Vlist, Mechelen (NL)

(73) Assignee: Laura Metaal Holding B.V., Eygelshoven (NL)

( * ) Notice: Subject to any disclaimer, the term of this patent is extended or adjusted under 35 U.S.C. 154(b) by 0 days.

(21) Appl. No.: 16/468,142

(22) PCT Filed: Nov. 20, 2017

(86) PCT No.: PCT/NL2017/050752
§ 371 (c)(1),
(2) Date: Jun. 10, 2019

(87) PCT Pub. No.: WO2018/111089
PCT Pub. Date: Jun. 21, 2018

(65) Prior Publication Data

US 2020/0173122 A1 Jun. 4, 2020

(30) Foreign Application Priority Data

Dec. 16, 2016 (NL) ..... 2018014

(51) Int. Cl.
*E01F 15/00* (2006.01)
*E01F 15/08* (2006.01)

(52) U.S. Cl.
CPC ..... *E01F 15/08* (2013.01); *E01F 15/085* (2013.01); *E01F 15/086* (2013.01); *E01F 15/088* (2013.01)

(58) Field of Classification Search
CPC ..... E01F 15/08; E01F 15/085; E01F 15/086; E01F 15/088
USPC ..... 404/6
See application file for complete search history.

(56) References Cited

U.S. PATENT DOCUMENTS

| | | | | |
|---|---|---|---|---|
| 4,423,854 | A * | 1/1984 | Cobb | E01F 15/083 256/13.1 |
| 7,306,397 | B2 * | 12/2007 | Albritton | E01F 15/0423 404/6 |
| 7,871,220 | B2 * | 1/2011 | Albritton | E01F 15/0423 404/6 |
| 8,061,925 | B2 * | 11/2011 | Volkmann | E01F 15/088 256/13.1 |
| 8,393,822 | B2 * | 3/2013 | Hotchkin | E01F 15/088 256/13.1 |
| 2006/0193688 | A1 * | 8/2006 | Albritton | E01F 15/146 404/6 |

(Continued)

FOREIGN PATENT DOCUMENTS

| | | | |
|---|---|---|---|
| EP | 3029202 | A1 | 6/2016 |
| WO | 2005085533 | A1 | 9/2005 |
| WO | 2008062196 | A1 | 5/2008 |

*Primary Examiner* — Raymond W Addie
(74) *Attorney, Agent, or Firm* — The Webb Law Firm

(57) ABSTRACT

A barrier element for bounding a carriageway including an elongated casing, having two opposing longitudinal side walls and an upper wall joining the two side walls; and at least one casing support structure located in the elongate casing and connecting to both the side walls. Additionally, a support structure for use in a barrier element.

18 Claims, 6 Drawing Sheets

(56) References Cited

U.S. PATENT DOCUMENTS

| | | | | |
|---|---|---|---|---|
| 2007/0194292 | A1* | 8/2007 | Serafin | E01F 15/025 256/13.1 |
| 2008/0067484 | A1* | 3/2008 | Amengual Pericas | E01F 15/0476 256/13.1 |
| 2010/0061800 | A1* | 3/2010 | Riddell | E01F 15/088 404/6 |
| 2012/0037865 | A1* | 2/2012 | Von Linsingen-Heintzmann | E01F 15/085 256/13.1 |
| 2019/0330813 | A1* | 10/2019 | Ramaekers | E01F 15/085 |
| 2020/0109531 | A1* | 4/2020 | Powell | E01F 15/006 |

* cited by examiner

BARRIER ELEMENT AND SUPPORT STRUCTURE FOR USE IN A BARRIER ELEMENT

CROSS-REFERENCE TO RELATED APPLICATIONS

This application is the United States national phase of International Application No. PCT/NL2017/050752 filed Nov. 20, 2017, and claims priority to Dutch Patent Application No. 2018014 filed Dec. 16, 2016, the disclosures of which are hereby incorporated by reference in their entirety.

BACKROUND OF INVENTION

Field of Invention

The present invention relates to a barrier element for bounding a carriageway comprising an elongated casing, comprising two opposing longitudinal side walls and a, the two side walls joining, upper wall; and at least one casing support structure located in the elongate casing and connecting to both the side walls. The invention further relates to a support structure for use in a barrier element.

Description of Related Art

Barrier elements for bounding carriageways are well known and widely used. These barrier elements are typically connected end-to-end to form an elongated barrier to protect traffic from roadside obstacles or hazards or to prevent vehicles from crossing over a median and striking an oncoming vehicle. Due to their elongated casing, these type of barrier elements may be freestanding and easy to deploy, making them especially suited for temporary use. As an alternative these type of barrier elements may also be more (semi-)permanently fixed to a roadbed (or other artificial construction like for instance a bridge or ramp) in situations where only a limited deflection distance is allowed. Such (semi-)permanently fixed barrier elements are also referred to as "minimum deflection barrier systems".

In order to reduce the severity of a collision, road side barriers typically absorb at least part of the kinetic energy of an object, and specifically a vehicle, colliding with said barrier. Common barrier elements hereby plastically deform as a method to dissipate the kinetic energy. The barrier must on the other hand be sufficiently rigid to retain its barrier function. For this reason, common barrier elements are provided with an internal support structure. This internal support structure however (locally) reduces the barrier's capability of deforming, thereby reducing its energy dissipation properties.

It is therefore the goal of the present invention to overcome the drawbacks of the known barrier elements by providing a barrier element with increased energy dissipation properties while retaining structural rigidity.

SUMMARY OF THE INVENTION

The present invention thereto provides a barrier element, wherein at least one of the side walls of a casing is connected to a support structure at least at two spaced apart locations, such that between the at least two spaced apart connection locations of the support structure and the side wall the support structure and the side wall are situated at a distance of each other, leaving a mutual transposition space. The distance between the support structure and the side wall providing the mutual transposition space may be at least 4 mm, preferably at least 6 mm, more preferably at least 8 or 10 mm. The mutual transposition space is a functional space created between the support structure and the side wall that allows for the side wall to deform inwards without directly contacting the support structure. This ability of the side wall to deform allows the barrier to absorb and consecutively dissipate the kinetic energy of a vehicle colliding into said side wall, causing the vehicle to more gradually decelerate to minimize the deceleration (G-forces) experienced by the passengers as well as minimizing damage to the vehicle. At the same time as the side wall is able to deform inwards into the space created by the at a distance situated support structure and side wall, the support structure will be prevented from deforming and will (more or less) retain its shape, guaranteeing the structural integrity of the barrier.

Note that within the context of the invention, the elongated casing of the barrier wall comprises two opposing longitudinal side walls and an upper wall joining the two side walls, which side walls and upper wall constitute different parts of the elongated casing. The side walls and the upper wall may hereby constitute part of a continuously folded sheet of material (metal), but could also be formed by separate material (metal) sheets that are mutually connected (e.g. by means of welding). It is likewise possible that the connections do not coincide with the transition between different casing parts. In a common embodiment, the barrier casing comprises two halves that are connected at the top, wherein the halves both constitute (part of) the side wall as well as a part of the upper wall.

In a preferred embodiment of the barrier element according to the invention, the spaced apart connection locations of the support structure and the side wall are separated in a plane perpendicular to the longitudinal direction of the casing. This separation of the connection locations in a plane perpendicular to the longitudinal direction of the casing, which during intended use of the barrier element coincides with a vertical direction, creates a deformation space that extends in the longitudinal direction of the casing. As a vehicle collides with the barrier element, it typically hits the barrier element at an angle. The barrier element then deflects the vehicle thereby changing the direction of movement of the vehicle such that it follows the barrier element in its longitudinal direction. During this movement, the longitudinally extending deformation space acts as a continuous deformation area for the vehicle that effectively absorbs the vehicle's kinetic energy.

In a further embodiment of the barrier element according to the invention, at least one of the side walls is provided with at least one indentation, elongated in the direction of elongation of the casing and projecting towards the support structure. The indented portion of the side wall preferably at least partly abuts the support structure to form a connection location of the support structure and the side wall. More preferably, the side wall is provided with at least two of such indentations elongated in the direction of elongation of the casing, wherein the indented portions form connection locations between the support structure and the side wall. The portion of the side wall between the two indented portions as a consequence then protrudes in an outward direction, forming a deformation area. This protruding part of the side wall is preferably located at a location between the base and the top of the barrier element where a vehicle with a contact surface (e.g. a bumper) first contacts the barrier element in case of a collision.

It is preferred that the support structure is at a side facing one of the side walls provided with at least one indentation projecting away from said side wall to form an abutment for the indentation provided in said side wall. As the shape of the support structure follows the shape of the side wall contact surface of side wall with support structure is increased, benefiting the support function of the support structure. The indentation in the support structure hereby preferably form-fits the indented shape of the side wall such that the side wall rests firmly against the support structure.

In another preferred embodiment of the barrier element according to the invention, both the side walls of the casing are connected to the support structure at least at two spaced apart locations, such that between the at least two spaced apart connection locations of the support structure and each of the side walls the support structure and the side walls are on distance of each other. In this way, a functional space between the support structure and the side wall is created on either side of the barrier element. The resulting barrier is especially suited for application as a median barrier designed to be struck from either side. To obtain a barrier element with identical barrier properties on either side of the barrier, the barrier element may take a symmetrical design, wherein the barrier element is symmetrical in a plane perpendicular to the direction of elongation of the casing with respect to a vertical axis of symmetry.

In an advantageous embodiment of the barrier element according to the invention at least one of the side walls is provided with at least one slit, that cooperates with a protruding part of the casing support structure. The slit and the protruding part hereby allow the support structure and the side wall to be correctly positioned relative to each other in a simple fashion. Furthermore, the correct relative placement of the support structure and the side wall may be easily confirmed on the hand of the slit and the protrusion by inspection of an outer side of the side wall. In the correct relative position of the support structure and the side wall, the slit should take up (at least part of) the protruding part of the support structure. Once the side wall and the support structure are placed into their correct relative positions, the side wall and support structure could be permanently fixed by welding together the slit and the protruding part.

In order to facilitate an easy production of the elongated casing, the side walls may be formed by a concatenation of straight wall parts. The resulting side wall may hereby be obtained by bending a single material (metal) plate along a series of parallel bending lines.

In yet a further embodiment of the barrier element according to the invention the upper wall is connected to the support structure. The support structure therefor extends up to the upper wall of the elongated casing, providing the casing with additional support due to the increased contact surface of the support structure and the casing.

The support structure may in an advantageous embodiment of the barrier element according to the invention comprise a base having a trapezium-shaped cross-section in a plane perpendicular to the longitudinal direction of the casing. The base may hereby preferably be tapered in a downward direction, to provide the barrier element with a wider base, improving its stability.

It is preferred that the lower part of the side walls abuts the base of the support structure to form a supported lower side wall surface. This part of the side wall is hereby prevented up to at least a certain extend from deforming upon contact with a colliding vehicle, which could be advantageous in cases where an errant vehicle rides up the barrier at a low angle. In this case the barrier should preferably redirect the vehicle onto the road surface while minimising the damage on the bodywork of the vehicle, for which the barrier element should remain intact without deforming. To further prevent deformation of the lower part of the side wall, the side walls may form-fit the base of the upright.

The at least one support structure may comprise an essentially vertical plate positioned perpendicular to the longitudinal side walls of the casing. The thin-walled construction of the support structure allows the barrier element for a major part to be made out of plate material, such as steel sheeting. Moreover, the thin-walled support structure reduces the mass of the barrier element, making it easier to transport and handle. The essentially vertical plate of the support structure may transfer into an essentially horizontal support plate at the bottom end of the support structure to create a support surface for the barrier element to support onto. The vertical plate of the support structure is preferably bended at a right angle at its bottom end to form the horizontal support plate.

In a preferred embodiment of the barrier element according to the invention, the at least one side wall of the casing at a lower end bends inwards and the support structure is near the bottom end provided with a notch for receiving said inwardly bended end of the side wall. The side wall is herewith effectively kept at a distance from the (road) surface the barrier element is supported on. This allows for drainage of water underneath the barrier element and prevents the accumulation of dirt and debris near the base of the barrier. By providing a notch in the support structure for receiving the inwardly bended end of the side wall, the side wall is furthermore strongly secured to the support structure.

It is possible that the casing support structure is provided with a holder directed towards the top side of the barrier and the upper wall is provided with an aperture in line with the holder such that the holder is accessible from the outside of the barrier element. The described holder, made accessible by the aligned aperture in the upper wall, allows for the placement of objects on top of the barrier element. Suitable objects may include traffic signs, glare screens or even additional barrier elements.

In yet another embodiment of the barrier element according to the invention, an end side of the longitudinal casing is provided with a spacer plate, which spacer plate has a contour that follows the inside of the elongated casing. The end side of the barrier element is to be understood here as the front end of the barrier element that is typically placed against the front end of another barrier element so as to create an elongated road barrier. Often, both end sides of the barrier element are provided with coupling means to secure the barrier element to an adjacent barrier element. The spacer plate functions to maintain a fixed distance between the opposing side wall in case of a vehicle colliding with the barrier near or at an end side of a barrier element. This will ensure that the vehicle is guided further alongside the barrier instead of penetrating into the end side of an adjacent barrier element.

Finally, the invention also relates to a support structure for use in a barrier element according to any of the above described embodiments.

BRIEF DESCRIPTION OF THE DRAWINGS

The invention will now be elucidated into more detail with reference to non-limitative exemplary embodiments shown in the following figures. Corresponding elements are indicated with corresponding numbers in the figures. In the figures.

DESCRIPTION OF THE INVENTION

Figure 1:
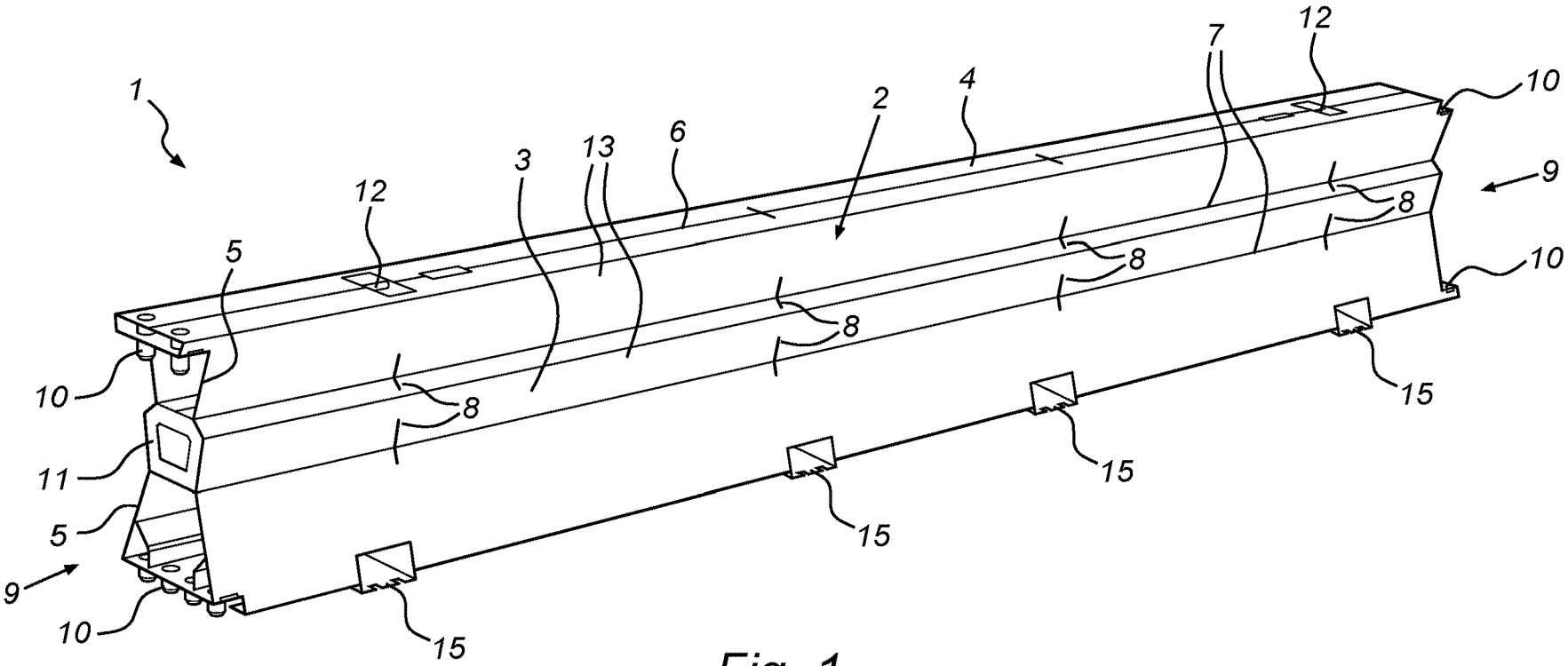
FIG. 1 shows a perspective view of a barrier element according to the invention.

FIG. 1 shows a perspective view of a barrier element 1 according to the invention. The barrier element 1 comprises an elongated casing 2 that includes two longitudinal opposing side walls 3 connected by an upper wall 4. In the barrier element shown here, the casing 2 is formed by two opposing longitudinal metal sheets 5, that each constitute a side wall 3 of the barrier element as well as together forming the upper wall 4 of the barrier element. The metal sheets 5 are joined at the top and connected by a suitable connection such as a weld 6. It is however equally possible to use other sheet materials such as plastic. It is moreover possible that the casing 2 comprises a single folded material sheet or more than two separate sheets that together make up the elongated casing 2. The side walls 3 of the casing 2 are provided with indentations 7, between which the casing protrudes in an outer direction. The casing is further provided with slits 8, position along the side walls 3 and upper wall 4 of the casing 2 and configured to receive a corresponding protrusion provided on the support structure 14 of the barrier element (see FIGS. 3 and 7). The barrier element 1 further comprises two end sides 9 provided with coupling elements 10 for coupling with another barrier element. At the end sides 9 of the barrier element, the casing 2 encloses a spacer plate 11 having a contour that follows the inside of the casing 2.

Figure 2:
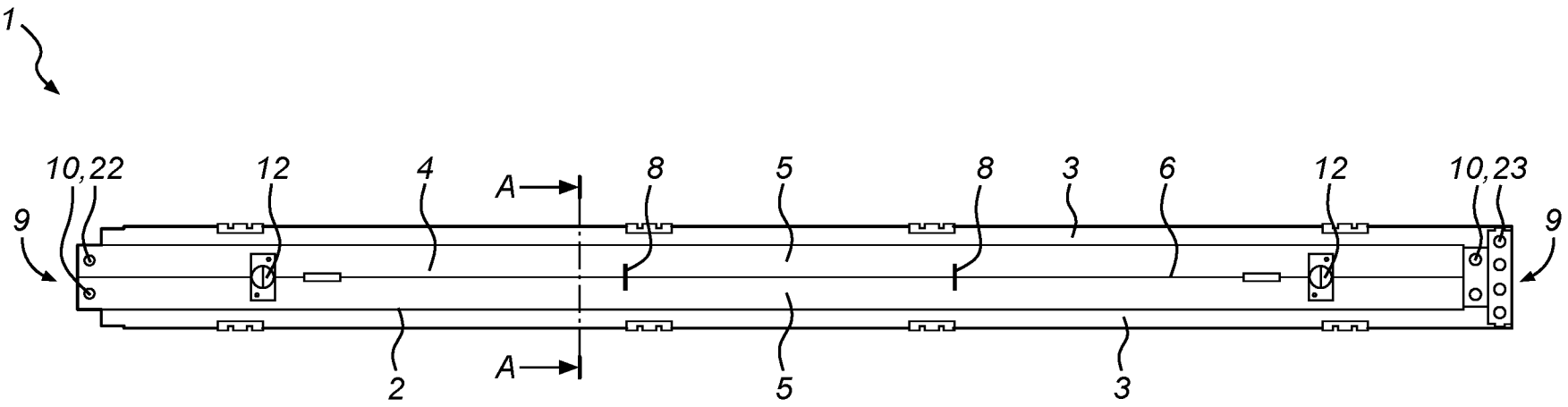
FIG. 2 shows a top view of the barrier element of FIG. 1.

FIG. 2 shows a top view of the barrier element 1 of FIG. 1. As could be clearly seen from this top view, the elongated casing 2 of the barrier elements is formed by two metal sheets 5 that are joined at the top and connected by a weld 6. The upper wall 4 of the casing 2 is provided with slits 8 to guide through the protruding parts 17 provided on the support structure 14 (see FIGS. 3 and 7). The upper wall 4 is further provided with an aperture 12 which lies in line with a holder directed towards the top side 4 of the barrier 1 that may be provided in the support structure 14.

Figure 3:
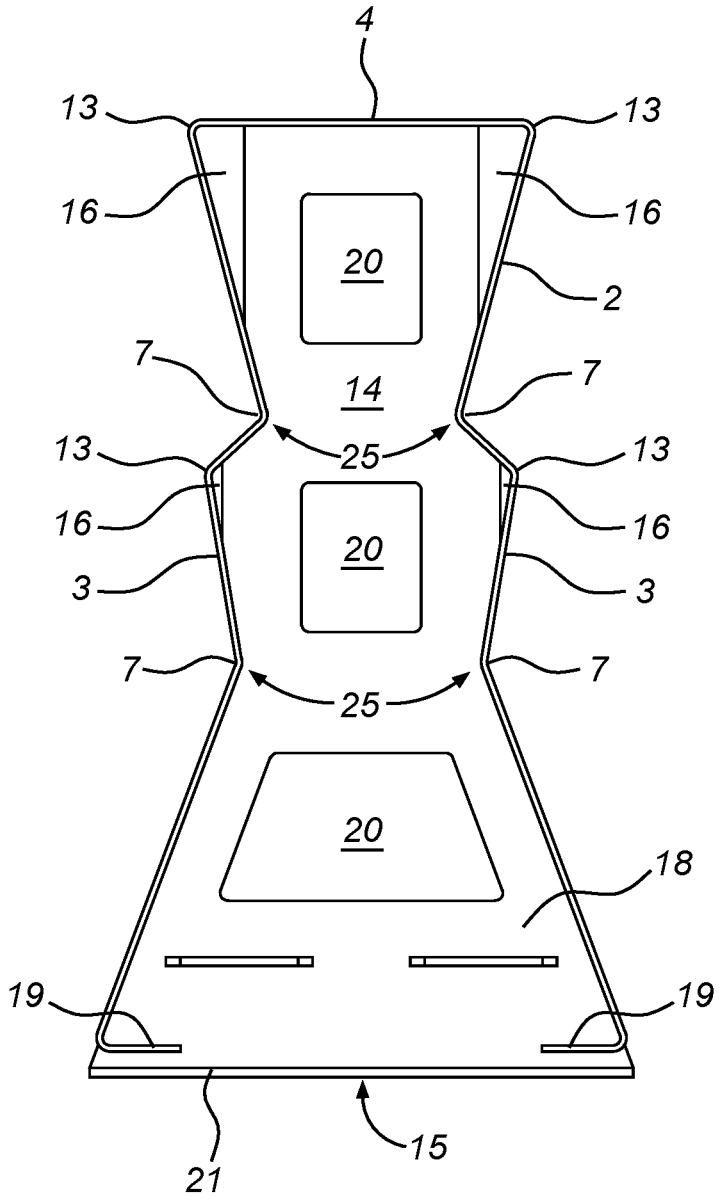
FIG. 3 shows a cross section of the barrier element of FIG. 1 along line A-A as shown in FIGS. 2 and 4.
Figure 4:
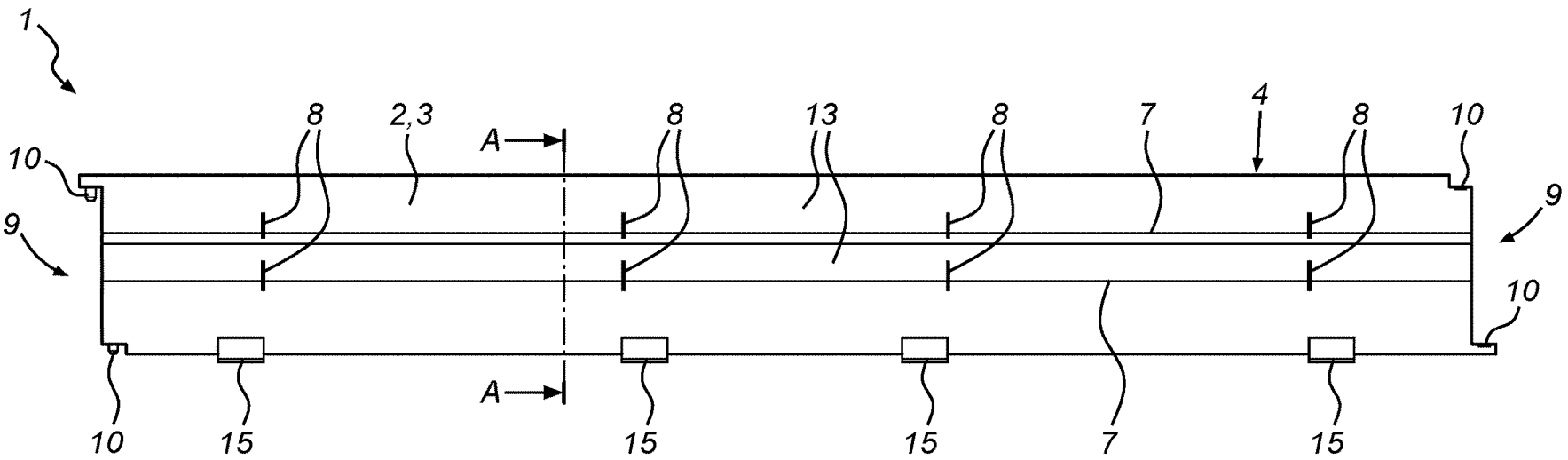
FIG. 4 shows a side view of the barrier element of FIG. 1, FIGS. 5*a*-5*b* show a detailed perspective view of the respective end sides of the barrier element of FIG. 1.

FIG. 3 shows a cross section of the barrier element of FIG. 1 along line A-A as shown in FIGS. 2 and 4. Again shown is the elongated casing 2 that formed by a concatenation of straight wall parts that define a series of alternating indentations 7 and protruding parts 13. Located in the elongate casing 2 and connecting to both the side walls 3 is a casing support structure 14. Although a barrier element 1 could contain a single support structure, the shown embodiment of the barrier element comprises several (four) of such casing support structures 14. The support structure 14 itself extends from the base of the barrier element 1, where it constitutes a support surface 15 of the barrier element, to the top of the barrier element where it contacts the upper wall 4 of the casing 2. At the sides of the support structure 14 facing the side walls 3 of the casing 2, the support structure is provided with indentations 25 which function as an abutment for the side walls 3, and specifically the indented parts 7 of the side walls. It is also at these spaced-apart locations that the side walls 3 of the casing 2 are connected to the support structure 14. Between these locations, the side walls 3 protrude outwards, wherein the side walls 3 and the support structure 14 are on distance of each other such that a space 16 is present between the side walls 3 and the support structure 14. The casing support structure 14 is further provided with protruding parts 17 that are received in corresponding slits 8 provided in the casing 2. The support structure comprises a base 18 having a trapezium-shaped cross-section that widens towards its lower end. The side walls 3 connect to the trapezium-shaped base 18 and at a lower end bend inwards to be received in a notch 19 provided near the bottom end of the support structure 14. As a consequence, the side walls 3 of the elongated casing 2 stay clear off the ground surface. Support structure 14 is provided with holes 20 to reduce its weight and that of the barrier element 1.

FIG. 4 shows a side view of the barrier element 1 of FIG. 1, depicting a side wall 3 of the elongated casing 2, comprising two longitudinally extending indentations 7 and multiple slits 8 for receiving a protruding part 17 of one of the support structures 14. The support structures 14 are at a bottom end provided with essentially horizontal support plates 21 that support the barrier element 1 and form the contact surfaces of the barrier element 1 with the ground (or road) they are placed on. The end sides 9 of the barrier element 1 are provided with coupling elements 10 that are shown in more detail in the following FIGS. 5*a* and 5*b*.

Figure 5B:
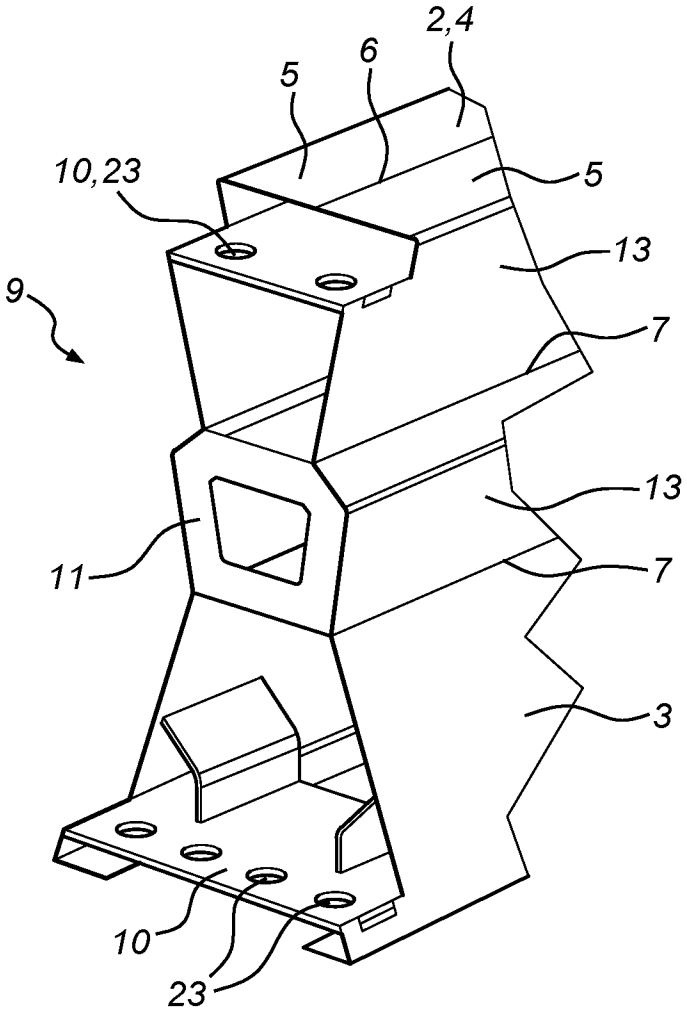
Figure 5A:
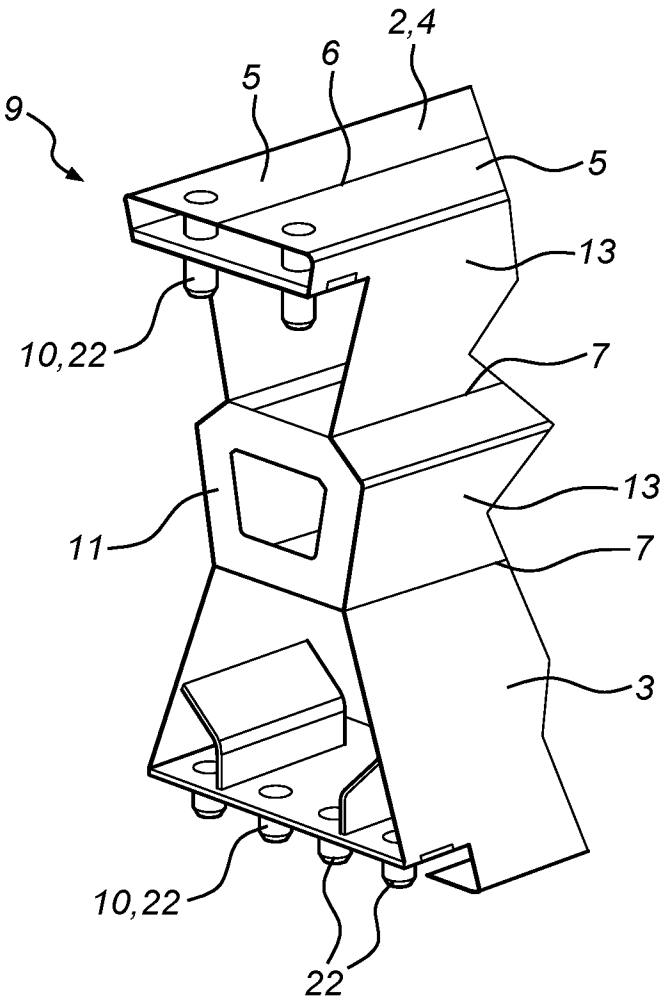

FIGS. 5*a*-5*b* show a detailed perspective view of the respective end sides 9 of the barrier element 1 of FIG. 1. As may be seen here as well, the casing 2 is formed by two opposing longitudinal metal sheets 5, that each constitute a side wall 3 of the barrier element 1 as well as together forming the upper wall 4 of the barrier element. The metal sheets 5 are joined at the top and connected by a weld 6. At a lower end the side walls 3 bend inwards to stay clear off the ground. Both end sides 9 are provided with a spacer plate 11, which spacer plate has a contour that follows the inside of the elongated casing 2. In addition, both end sides 9 are provided with coupling elements 10 that cooperate with complementary coupling elements 10 of a neighbouring barrier element 1 in order to couple the respective barrier elements end-to-end. On a first end side 9 of the barrier element 1, the coupling elements 10 in the shown embodiment comprise multiple pins 22. These pins 22 cooperate with corresponding holes 23 comprised in the coupling elements 10 of the second end side of another, adjacent barrier element 1. The shown coupling elements 10 allow for a rapid deployment and removal of the barrier, as individual barrier elements 1 are coupled just by lowering the barrier elements in a vertical direction. It is however equally possible that the barrier element 1 is provided with other coupling means for the purpose of coupling the end sides 9 of adjacent barrier elements.

Figure 6:
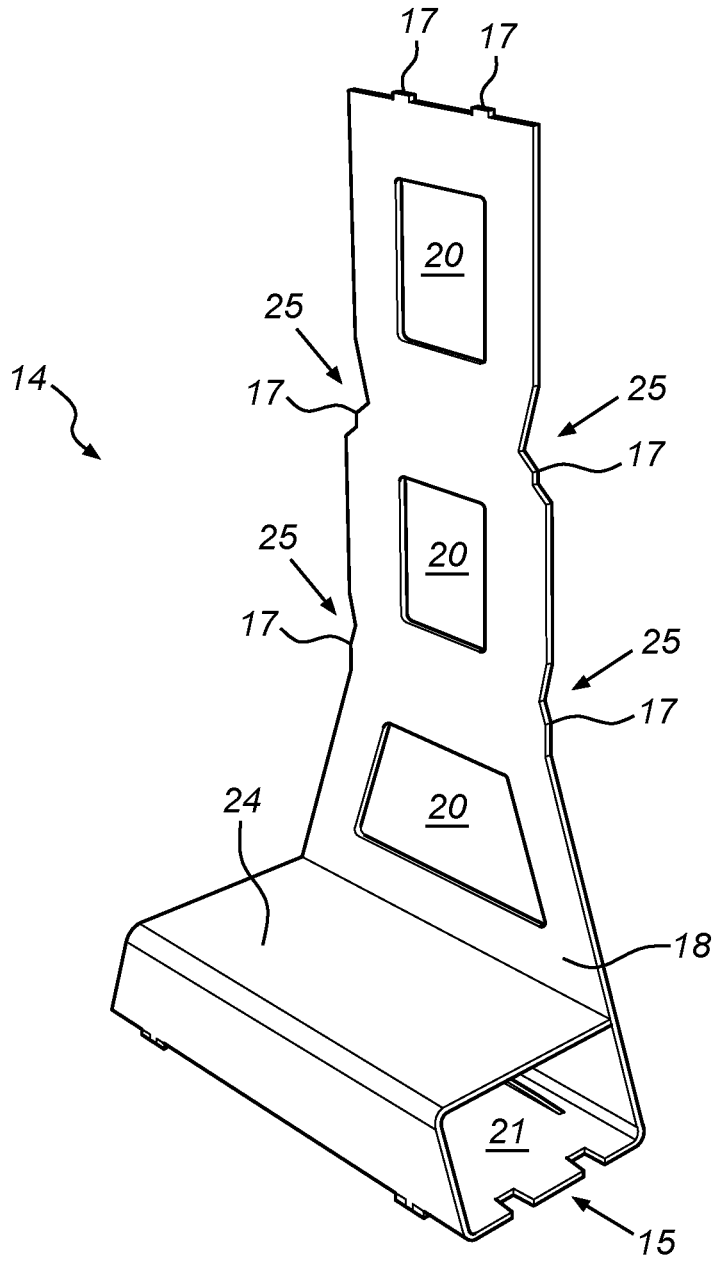
FIG. 6 shows a perspective view of a casing support structure according to the invention.

FIG. 6 shows a perspective view of a casing support structure 14 according to the invention. The support structure 14 comprises an essentially vertical plate which is configured to be positioned perpendicular to the longitudinal side walls 3 of the casing 2. At the bottom end of the support structure 14, the vertical plate of the support structure transfers into an essentially horizontal support plate 21. For additional strength the base of the support structure 14 is in this particular embodiment provided with additional wall parts that together form a hollow beam 24. The sides of the support structure 14 that face the casing 2 are provided with indentations 15, which form an abutment for the (indented parts of the) casing 2. Moreover, protrusions 17 are provided alongside the sides of the support structure 14 facing the casing 2 that are configured to be received in corresponding slits 8 provided in the casing 2. In addition, the support structure 14 may comprise a holder (not shown) that connects to the top side 4 of the barrier element 1 and is able to receive suitable objects such as traffic signs, glare screens or guidance rails.

It will be apparent that the invention is not limited to the exemplary embodiments shown and described here, but that within the scope of the appended claims numerous variants are possible which will be self-evident to the skilled person in this field. It is possible here to envisage that different inventive concepts and/or technical measures of the above described embodiment variants can be wholly or partially combined without departing from the inventive concept described in the appended claims.

The invention claimed is:

1. A barrier element for bounding a carriageway, comprising:

an elongated casing, comprising two opposing longitudinal side walls and an upper wall joining the two side walls; and at least one casing support structure located in the elongate casing and connecting to both the side walls;

wherein at least one of the side walls of the casing is connected to the support structure at least at two spaced apart locations, such that between the at least two spaced apart connection locations of the support structure and the side wall, the support structure and the side wall are situated at a distance of each other, leaving a mutual transposition space, wherein at least one of the side walls is provided with at least one indentation, elongated in the direction of elongation of the casing and projecting towards the support structure, and wherein the support structure is at a side facing one of the side walls provided with at least one indentation projecting away from said side wall to contact and form an abutment with the indentation provided in said side wall.

2. A barrier element according to claim 1, characterised in that the distance between the support structure and the side wall providing the mutual transposition space is at least 4 mm.

3. A barrier element according to claim 1, characterised in that the spaced apart connection locations of the support structure and the side wall are separated in a plane perpendicular to the longitudinal direction of the casing.

4. A support structure for use in a barrier element according to claim 1.

5. A barrier element according to claim 1, wherein the at least one indentation of the at least one of the sidewalls comprises a first indentation and a second indentation spaced from the first indentation, wherein the at least one indentation of the support structure comprises a third indentation contacting and forming an abutment with the first indentation, and a fourth indentation contacting and forming an abutment with the second indentation.

6. A barrier element according to claim 1, characterised in that both the side walls of the casing are connected to the support structure at least at two spaced apart locations, such that between the at least two spaced apart connection locations of the support structure and each of the side walls the support structure and the side walls are on distance of each other.

7. A barrier element according to claim 1, characterised in that at least one of the side walls is provided with at least one slit, that cooperates with a protruding part of the casing support structure.

8. A barrier element according to claim 1, characterised in that the side walls are formed by a concatenation of straight wall parts.

9. A barrier element according to claim 1, characterised in that the upper wall is connected to the support structure.

10. A barrier element according to claim 1, characterised in that the support structure comprises a base having a trapezium-shaped cross-section in a plane perpendicular to the longitudinal direction of the casing.

11. A barrier element according to claim 10, characterised in that the lower part of the side walls abuts the base of the support structure.

12. A barrier element according to claim 1, characterised in that the at least one support structure comprises an essentially vertical plate positioned perpendicular to the longitudinal side walls of the casing.

13. A barrier element according to claim 12, characterised in that the essentially vertical plate of the support structure transfers into an essentially horizontal support plate at the bottom end of the support structure.

14. A barrier element according to claim 1, characterised in that at least one side wall of the casing at a lower end bends inwards and the support structure is near the bottom end provided with a notch for receiving said inwardly bended end of the side wall.

15. A barrier element according to claim 1, characterised in that the casing support structure is provided with a holder directed towards the top side of the barrier and the upper wall is provided with an aperture in line with the holder such that the holder is accessible from the outside of the barrier element.

16. A barrier element according to claim 1, characterised in that an end side of the longitudinal casing is provided with a spacer plate, which spacer plate has a contour that follows the inside of the elongated casing.

17. A barrier element for bounding a carriageway, comprising:

an elongated casing, comprising two opposing longitudinal side walls and an upper wall joining the two side walls; and at least one casing support structure located in the elongate casing and connecting to both the side walls;

wherein at least one of the side walls is provided with at least one indentation, elongated in the direction of elongation of the casing and projecting towards the support structure, and wherein the support structure is at a side facing one of the side walls provided with at least one indentation projecting away from said side wall to contact and form an abutment with the indentation provided in said side wall.

18. A barrier element according to claim 17, wherein the at least one indentation of the at least one of the sidewalls comprises a first indentation and a second indentation spaced from the first indentation, wherein the at least one indentation of the support structure comprises a third indentation contacting and forming an abutment with the first indentation, and a fourth indentation contacting and forming an abutment with the second indentation.

* * * * *